US005918741A

United States Patent [19]

Vasudeva

[11] Patent Number: 5,918,741

[45] Date of Patent: Jul. 6, 1999

[54] TOOL CASE

[75] Inventor: Kailash C. Vasudeva, Waterloo, Canada

[73] Assignee: Maxtech, Inc., Roseville, Mich.

[21] Appl. No.: 09/018,015

[22] Filed: Feb. 3, 1998

Related U.S. Application Data

[63] Continuation-in-part of application No. 08/783,547, Jan. 14, 1997, abandoned.

[51] Int. Cl.[6] ..... B65D 85/78

[52] U.S. Cl. ..... 206/376; 206/234; 206/372

[58] Field of Search ..... D3/284, 282; 206/372, 206/374, 379, 234; 220/339

[56] References Cited

U.S. PATENT DOCUMENTS

| | | | |
|---|---|---|---|
| D. 148,322 | 1/1948 | Kane | 206/377 X |
| D. 163,263 | 5/1951 | Dodd et al. | 206/377 X |
| D. 293,740 | 1/1988 | Nadeau | D3/284 X |
| 2,509,507 | 5/1950 | Kane | 206/377 |
| 2,532,636 | 12/1950 | Minnich . | |
| 2,687,157 | 8/1954 | Cowan | 220/339 X |
| 2,877,919 | 3/1959 | Kobryner . | |
| 3,154,192 | 10/1964 | Cowley | 206/379 |
| 3,583,556 | 6/1971 | Wagner . | |
| 3,813,025 | 5/1974 | Solomon . | |
| 3,952,873 | 4/1976 | Pampuch et al. | 220/339 X |
| 4,269,311 | 5/1981 | Rich | 206/234 |
| 4,518,092 | 5/1985 | Contreras, Sr. . | |
| 4,643,316 | 2/1987 | Hoffman . | |
| 4,760,057 | 7/1988 | Wall-Andersen | 206/379 |
| 4,819,800 | 4/1989 | Wilson . | |
| 5,036,975 | 8/1991 | Chow | 206/376 |
| 5,271,501 | 12/1993 | Chen . | |
| 5,520,285 | 5/1996 | Mursch et al. | 206/379 X |

*Primary Examiner*—Bryon P. Gehman
*Attorney, Agent, or Firm*—R. Craig Armstrong

[57] ABSTRACT

The case has a molded plastic card member, and a lid specifically configured to mate with the card member to define an enclosed area. The lid is connected to the card member by a hinge adjacent one edge thereof so as to be foldable between an open position away from the card member, and a closed position against the card member to define the enclosed area. The card member and the lid preferably each have tabs extending from side edges opposite the hinge, each tab having a hole generally alignable with a corresponding hole in the other tab, for the installing of a closure such as a thick plastic loop not generally severable without a tool. The card member and lid define between them a number of openings through the enclosed area particularly sized for portions of tool components and/or extra tool components to extend therethrough generally parallel to the card member, for visibility and preferably manipulation, without it being possible to remove them as long as the case is closed. At least one of the enclosed area and an area of the card member outside the enclosed area have tool components and/or extra tool components receivers configured such that removal of a tool component and/or extra tool components through the openings from the enclosed area is prevented when the lid is in the closed position, by a wall of a recess, or by a raised stop or the like.

17 Claims, 10 Drawing Sheets

TOOL CASE

REFERENCE TO RELATED APPLICATIONS

This is a continuation-in-part of application Ser. No. 08/783,547, filed Jan. 14, 1997, now abandoned.

BACKGROUND OF THE INVENTION

This invention relates to a tool case, particularly adapted to receiving and holding, tool components.

The tool case is particularly intended to be used as a point-of-purchase holder and display means for the tool components, but also as a long-term storage means for the tool components. The tool components can be of any conventional type, including hex keys, TORX (trademark), etc., or any combination. Tool components may also include, what are commonly referred to as "bit-sockets", i.e. sockets having a hex key or other like bit extending therefrom, such that the bit can be driven by a socket wrench, or "sockets" on their own.

Conventionally, tool components, such as bit-sockets, have been sold in fully-enclosed cases, frequently with a solid plastic base and a non-transparent plastic cover, or on a skin package card, or in a pouch. The cases are then mounted on or within separate packaging, such as shrink wrapping or a blister pack, for positioning at the point of sale. Potential customers cannot gain access to the tool components, or in many cases even see what they are buying, since otherwise it would be too easy for dishonest customers to remove individual bit-sockets, an all-too-common occurrence, unfortunately.

Some tool components outwear other tool components that are sold as a set. In some instances it is convenient and advantageous to have "extra tool components" that replace worn out parts of tool components. For instance, sockets last a long time, but bits wear out. It is thus advantageous to have a case which can store extra bits which cannot be removed at the point of sale.

SUMMARY OF THE INVENTION

It is an object of the invention to provide a case which can be used both at the point of purchase and subsequently, and which offers advantages over the conventional packaging.

The case has a molded plastic card member, and a lid specifically configured to mate with the card member to define an enclosed area. The lid is connected to the card member by a hinge adjacent one edge thereof so as to be foldable between an open position away from the card member, and a closed position against the card member to define the enclosed area. The card member and the lid preferably each have tabs extending from side edges opposite the hinge, each tab having a hole generally alignable with a corresponding hole in the other tab, for the installing of locking means such as a thick plastic loop not generally severable without a tool. The card member and lid define between them a number of openings through the enclosed area particularly sized for portions of tool components and/or extra tool components to extend therethrough generally parallel to the card member, for visibility and preferably manipulation, without it being possible to remove them as long as the case is closed. At least one of the enclosed area and an area of the card member outside the enclosed area have tool components and/or extra tool components receiving means configured such that removal of a tool component and/or extra tool component through the openings from the enclosed area is prevented when the lid is in the closed position, by stop means such as a wall of a recess, or such as a raised stop.

Details of the invention will be described, or will become apparent, in the detailed description which follows.

BRIEF DESCRIPTION OF THE DRAWINGS

The invention will now be described in greater detail, with reference to the accompanying drawings of the preferred embodiments by way of example only, in which.

DETAILED DESCRIPTION OF THE PREFERRED EMBODIMENTS

Figure 1:
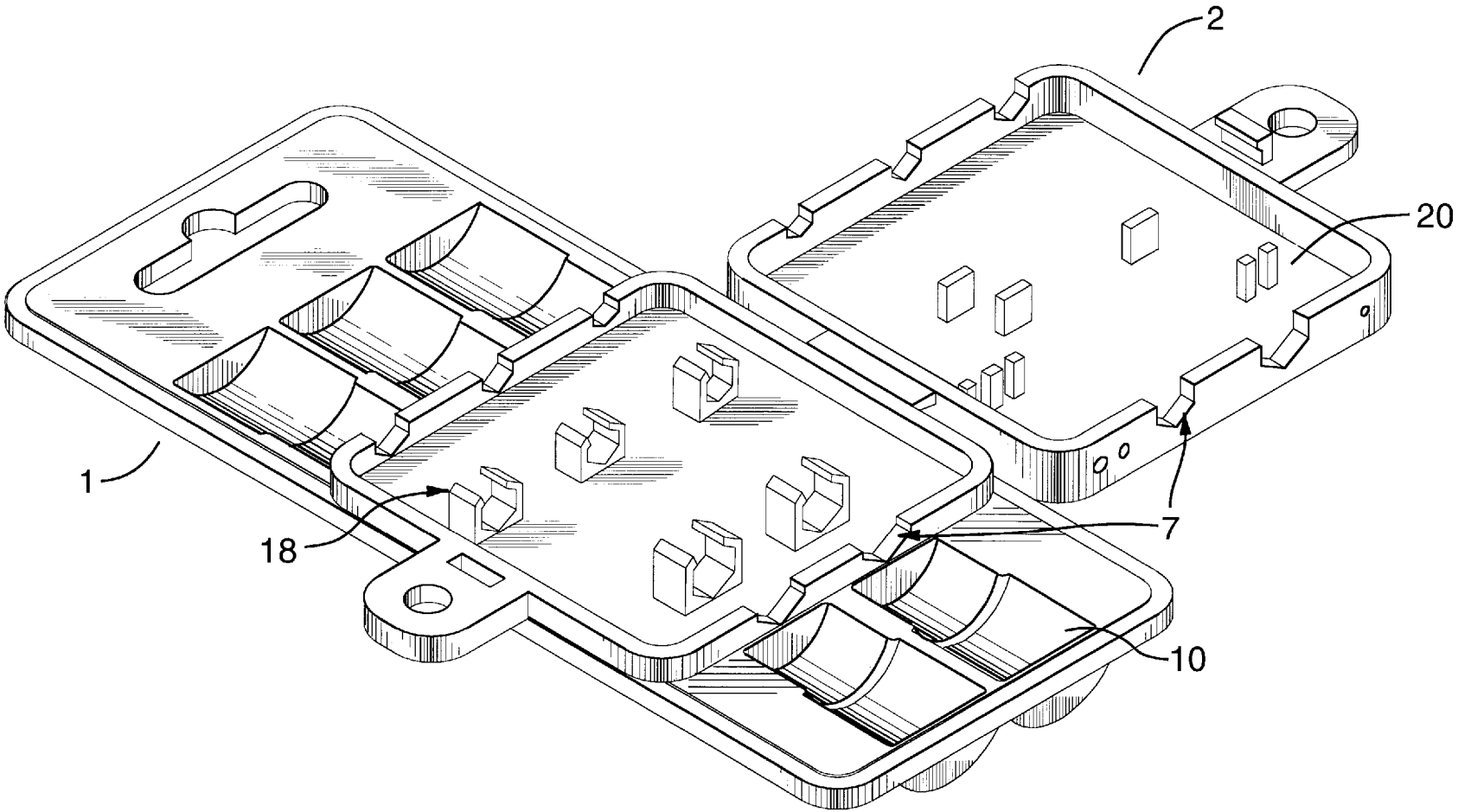
FIG. 1 is a perspective of the first embodiment.
Figure 3:
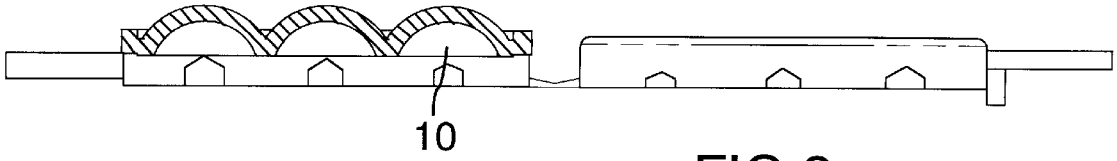
FIG. 3 is a corresponding partial cross-sectional top view without tool components.
Figure 2:
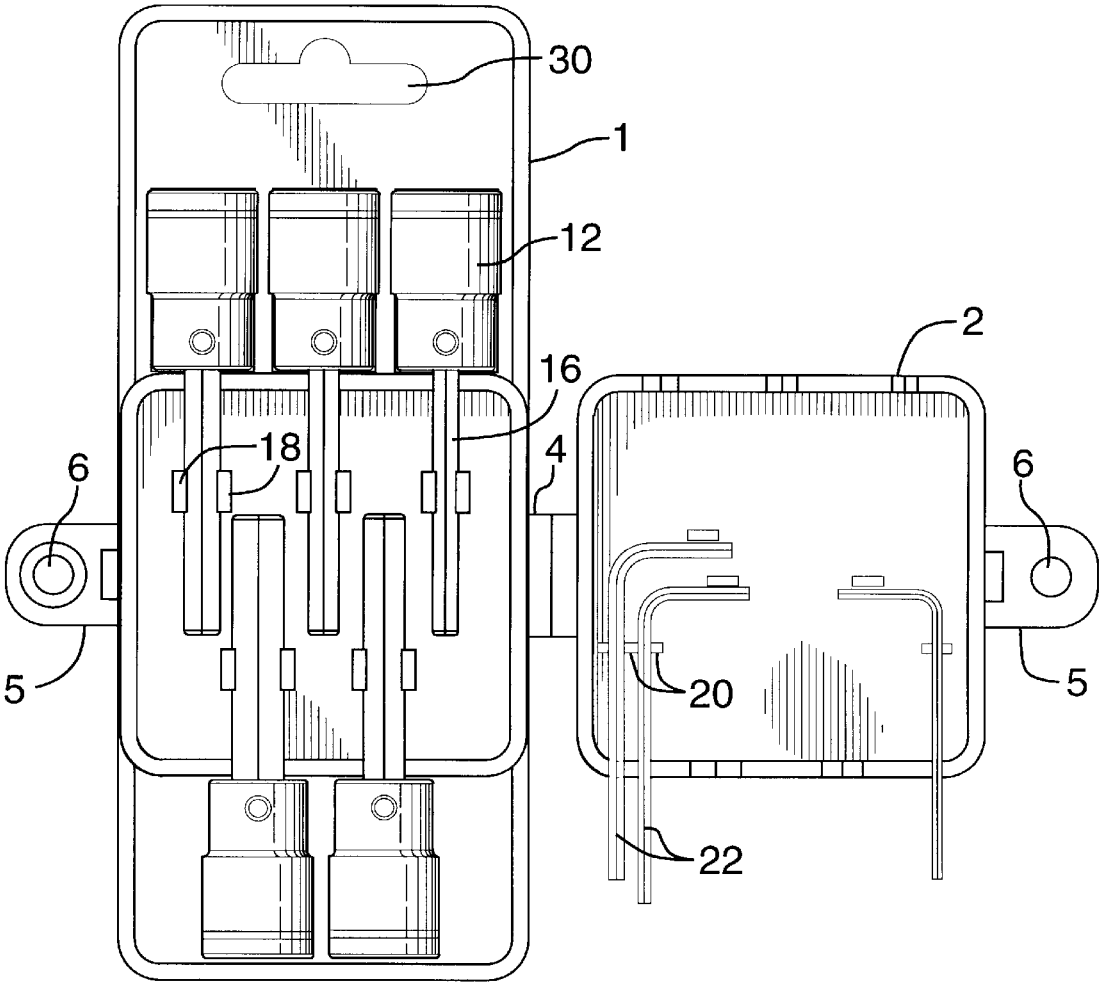
FIG. 2 is a corresponding plan view, in the open position.
Figure 4:
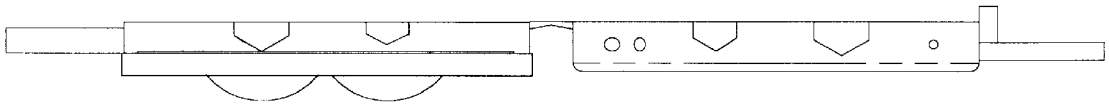
FIG. 4 is a corresponding full bottom view without tool components.
Figure 6:
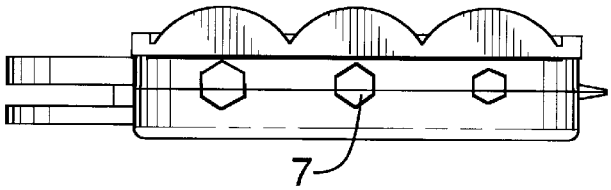
FIG. 6 is a corresponding top view without tool components.
Figure 5:
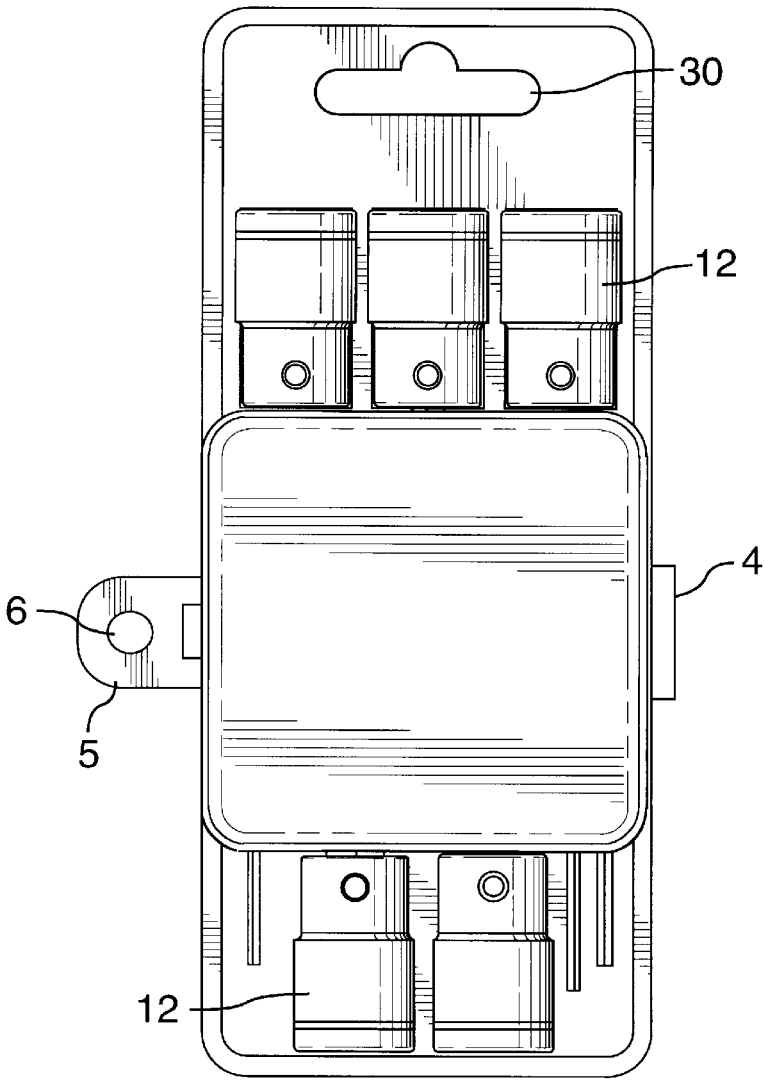
FIG. 5 is a plan view of the first embodiment, in the closed position.
Figure 7:
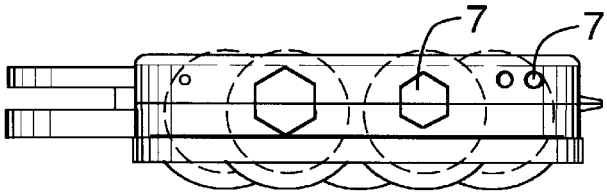
FIG. 7 is a corresponding bottom view without tool components.

The case, preferably of molded plastic, has a card member 1, and a lid 2 specifically configured to mate with the card member to define an enclosed area. The lid is connected, preferably integrally, to the card member by a hinge 4, such as a living hinge in the preferred embodiment, adjacent one edge thereof so as to be foldable between an open position away from the card member, and a closed position against the card member to define the enclosed area. The card member and the lid each have tabs 5 extending from side edges opposite the hinge, each tab having a hole 6 generally alignable with a corresponding hole in the other tab, for the installing of locking means such as a thick plastic loop (not illustrated) which is not generally severable without a tool. Casual thievery is thus discouraged. As a locking feature for subsequent use after purchase there is included a reusable tack clip on one tab and a corresponding hole on the other tab.

Figure 8:
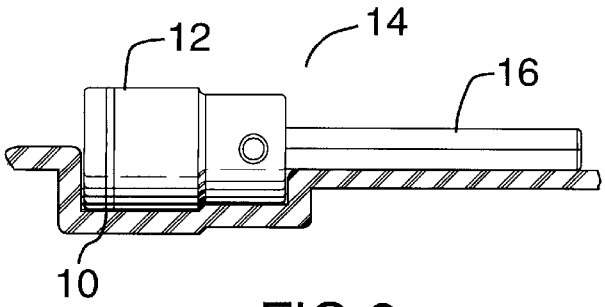
FIG. 8 is a side cross-sectional view of a bit-socket in a bit-socket receiving recess.
Figure 9:
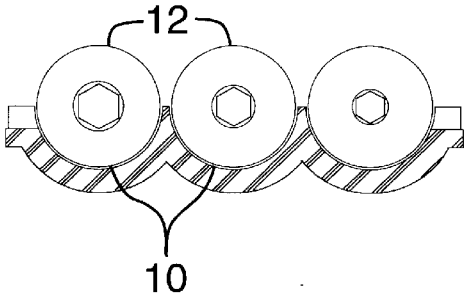
FIG. 9 is a corresponding top cross-sectional view.
Figure 10:
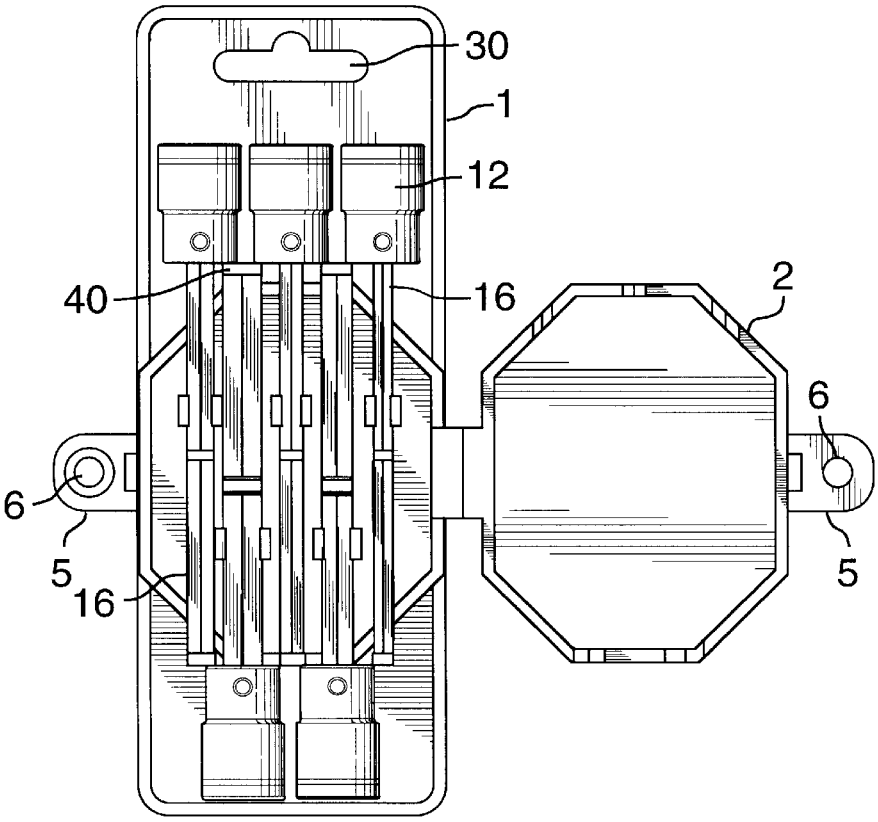
FIG. 10 is a plan view of a variation on the first embodiment, to specifically accommodate replacement bits.
Figure 12:
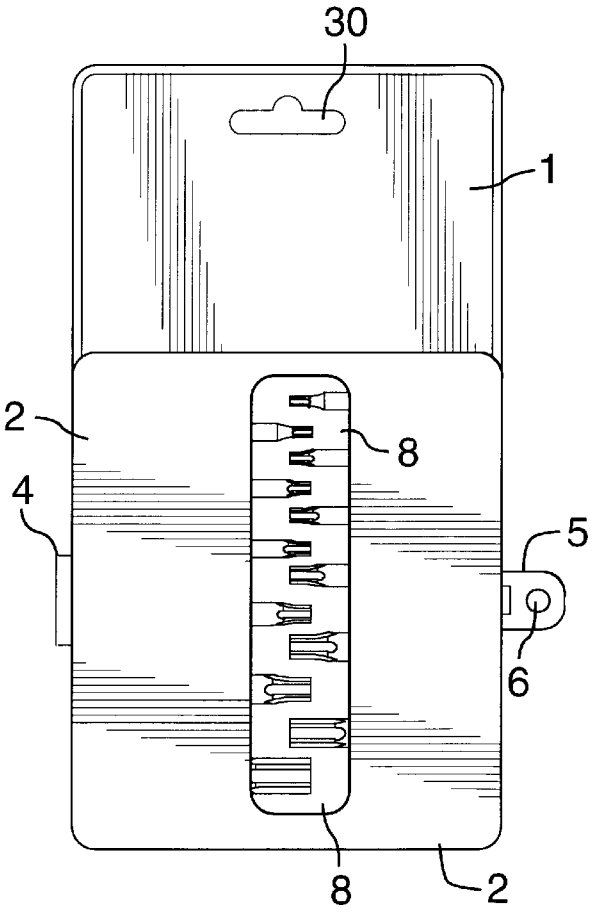
FIG. 12 is a corresponding view in the closed position.
Figure 11:
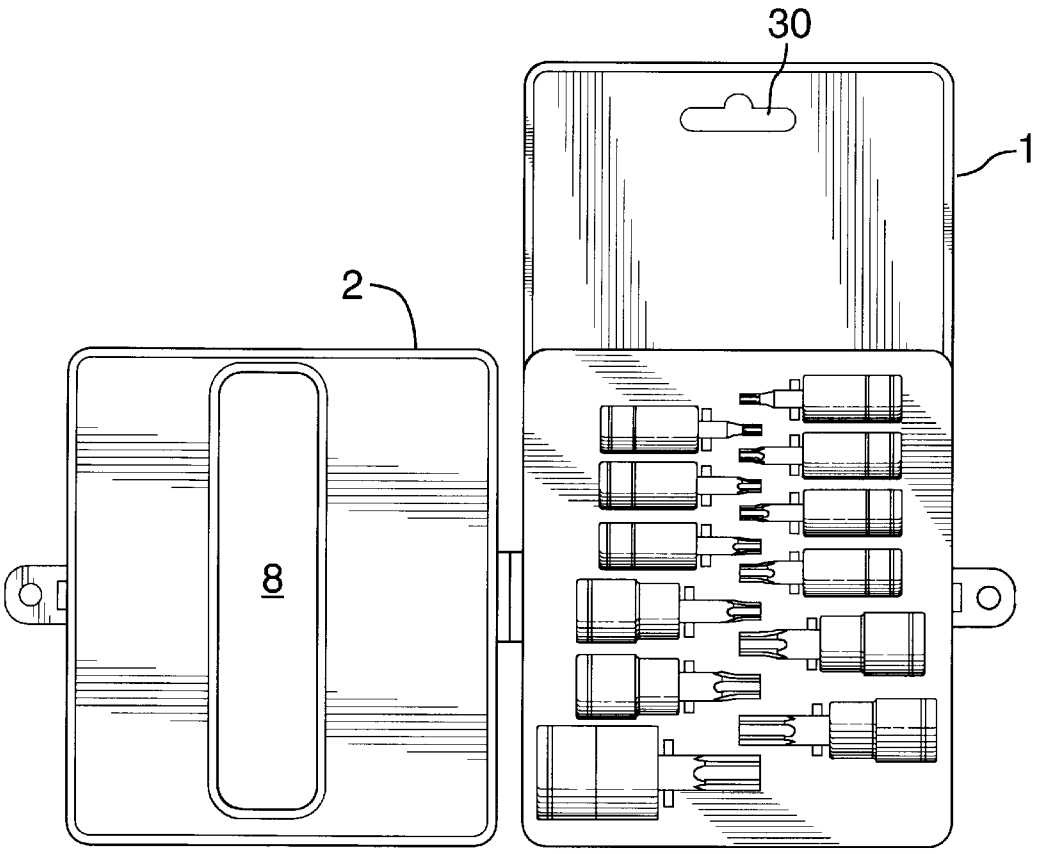
FIG. 11 is a plan view of a second embodiment, in the open position.
Figure 13:
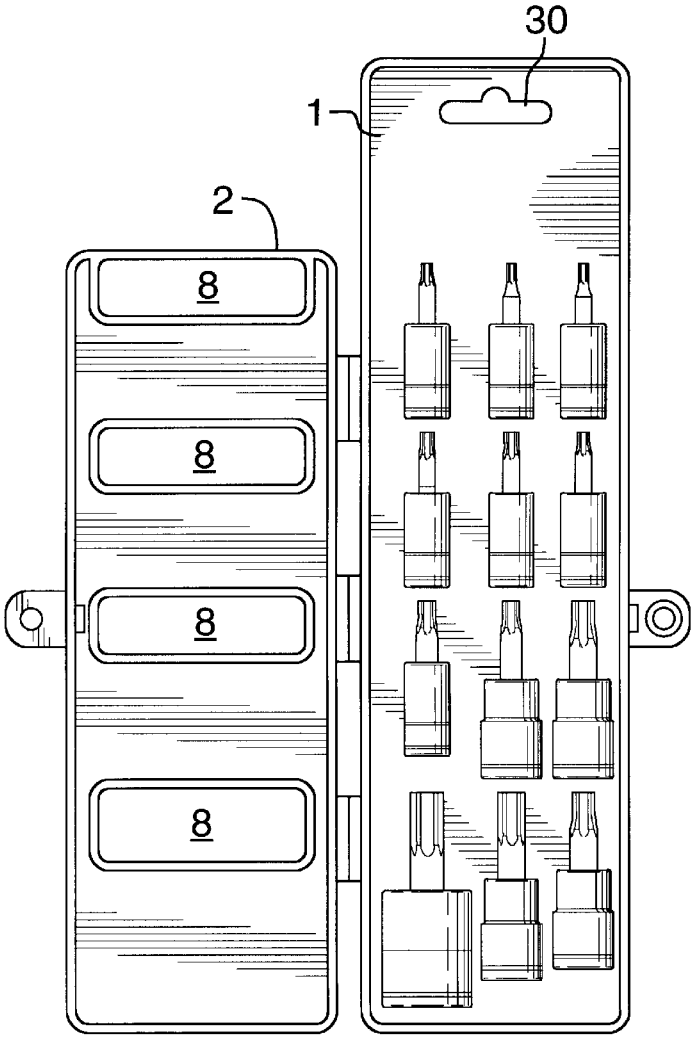
FIG. 13 is a plan view of a variation of the second embodiment, in the open position.
Figure 14:
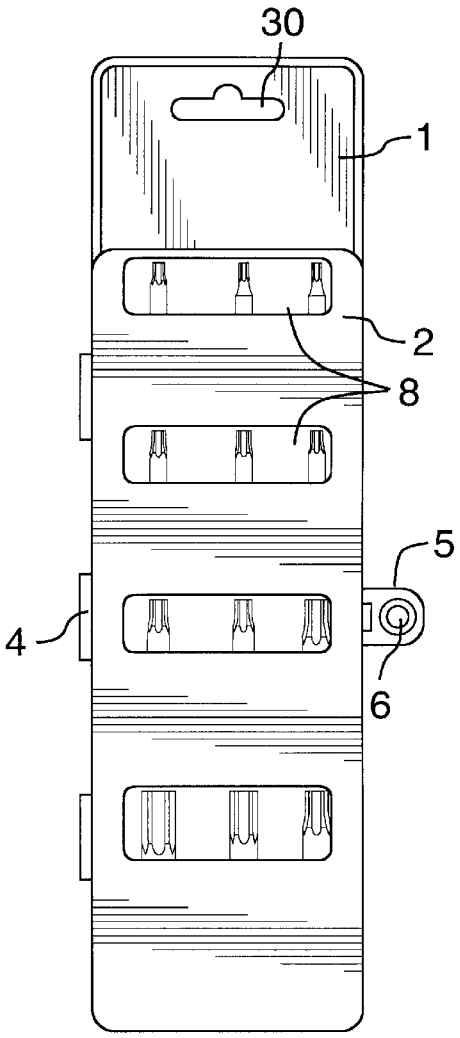
FIG. 14 is a corresponding view in the closed position.

The card member and lid define between them or on there own one or more openings 7 through or into which portions of tool components or extra tool components extend generally parallel to the card member. In the FIG. 10, there is shown in the first embodiment bit sockets and extra bits in the card member. At least one of the enclosed area and an area of the card member outside the enclosed area have tool components receiving means and/or extra tool component receiving means configured such that removal of a tool component, such as a bit-socket, and/or an extra tool component, such as a bit, through the openings from the enclosed area is prevented when the lid is in the closed position, by stop means such as a vertical wall of a recess 10, as shown in FIGS. 8 and 9, or such as a raised stop 40, as shown in FIG. 10. Preferably, there is little or no clearance between the wall of a recess or the raised stop and the tool component. In addition, it is preferable that the recess is of sufficient depth and the raised stop is of sufficient height when compared to the end width or diameter of the tool component that it is to prevent the removal of when the lid is in the closed position.

In one embodiment, with reference to FIGS. 8 and 9 the bit-socket receiving means includes several arcuate recesses 10 in the card member outside the enclosed area, generally sized to accommodate socket portions 12 of bit-sockets 14, with bit portions 16 of the bit-sockets extending through the openings 7 into the enclosed area, removal of the sockets when the lid is in the closed position being prevented by the stop means and the lid bearing against the bit portions to hold the socket portions within the arcuate recesses.

Preferably, the first embodiment, as shown in FIG. 1, also includes opposing projections 18 from the card member within the enclosed area, configured to snugly accommodate bit portions of the bit-sockets between them.

In the first embodiment as illustrated in FIGS. 1–10, there are three of the arcuate recesses 10 in the card member outside one end of the enclosed area, and two of the arcuate recesses outside an opposite end of the enclosed area, whereby five bit-sockets may be accommodated with bit portions extending into the enclosed area, the enclosed area having five pairs of the opposing projections 18, each to accommodate a bit portion of one of the five bit-sockets.

In the version shown in FIGS. 1–7, the lid preferably also includes a plurality of clip projections 20 therefrom, each to accommodate a hex key 22 or the like, with the hex keys extending from the enclosed area through further openings provided therethrough, preferably towards the end of the card member having the two arcuate recesses, laterally outwardly therefrom. Alternatively, as shown in FIG. 10, the "free" space can be used for replacement bits 16, which cannot be removed because of the presence of stops 40 projecting upwardly from the card.

The card member includes a "butterfly" opening 30 for hanging the case on a projecting rod, whether at the retail outlet or in the purchaser's workshop.

Figure 15:
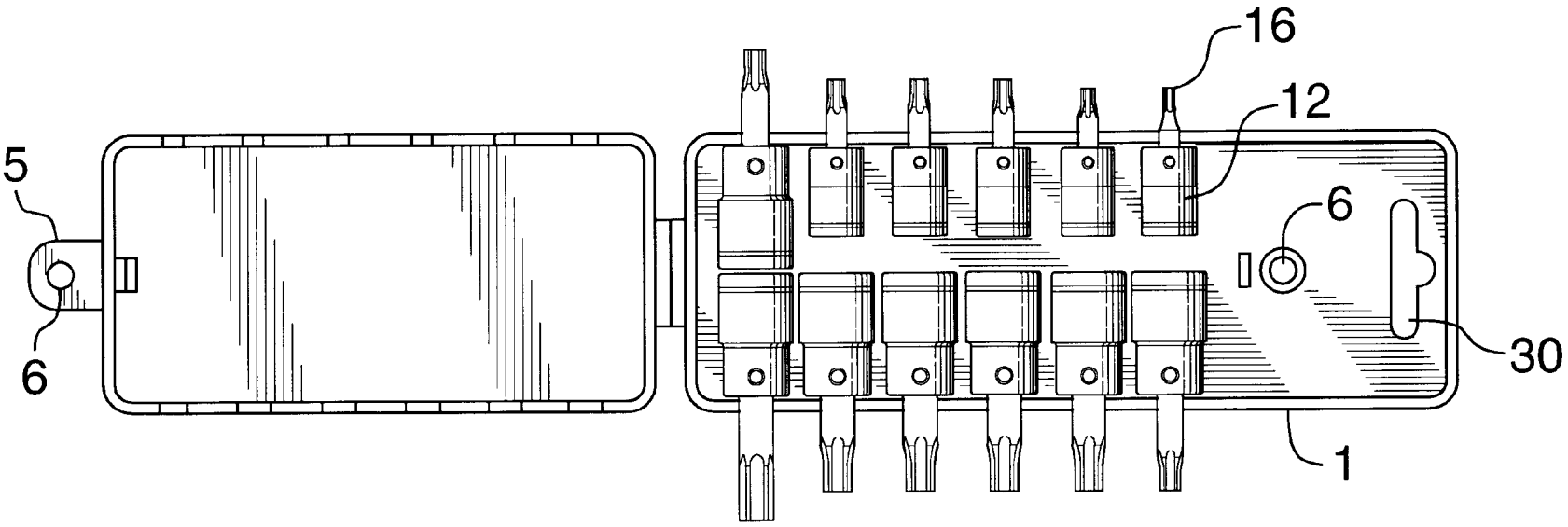
FIG. 15 is a plan view of a third embodiment, in the open position.
Figure 16:
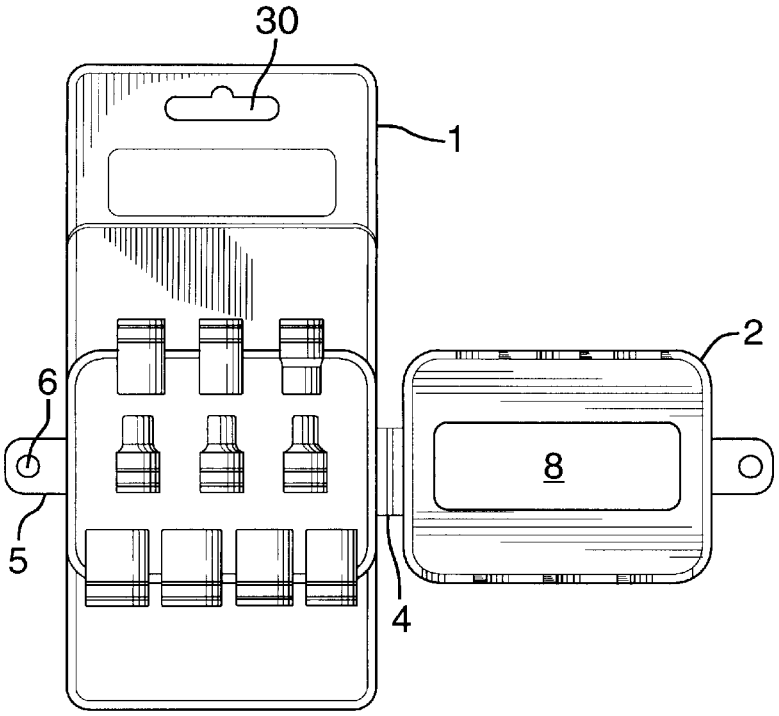
FIG. 16 is a plan view of a fourth embodiment, in the open position.
Figure 18:
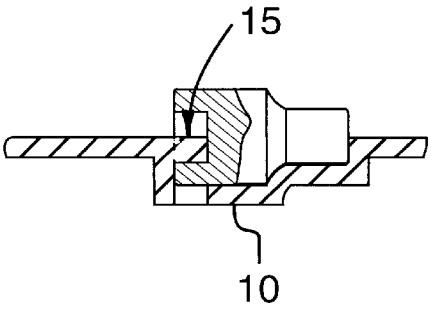
FIG. 18 is a side cross-sectional view of a socket in a socket receiving recess.
Figure 17:
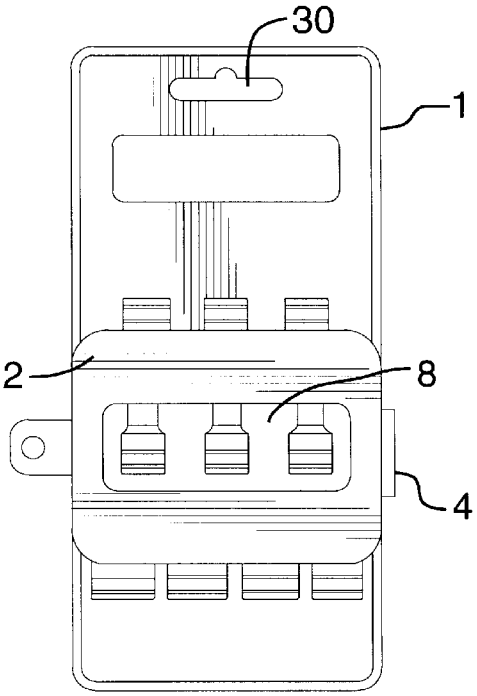
FIG. 17 is a corresponding view in the closed position.
Figure 19:
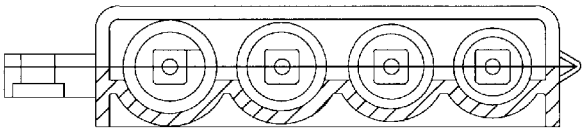
FIG. 19 is a corresponding partial bottom cross-sectional view.

In the alternative embodiments shown in FIGS. 11–24, the same principle is used, but the configurations are somewhat different. In FIGS. 11–14, for example, the tool components are accessible via apertures 8 instead of extending outside the enclosed area. In FIG. 15, the tool components extend laterally, beyond the edges of the card portion.

In another embodiment of the invention, as shown in FIGS. 16–19, the tool case is specifically updated to store only sockets. Again the same principle is used, but the configurations are somewhat different. In this instance, some or all the sockets are additionally secured to the card member by the tabs 15 extending from the edge of each arcuate recess and into the cavity of inserted sockets. The centre sockets are accessible via apertures 8 instead of extending outside the enclosed area.

Figure 21:
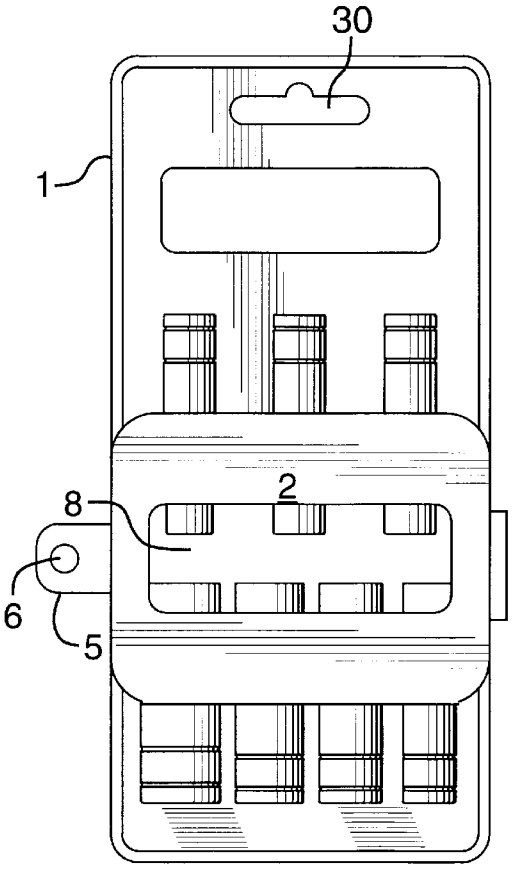
FIG. 21 is a corresponding view in the closed position.
Figure 20:
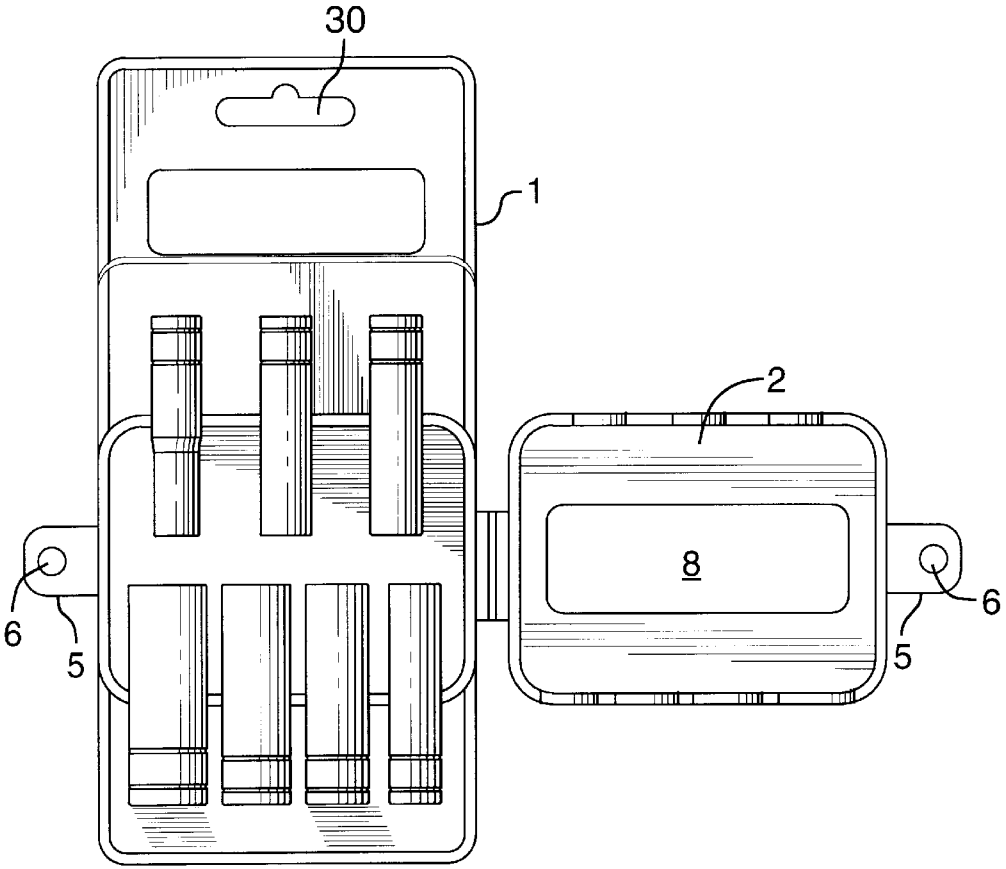
FIG. 20 is a plan view of a fifth embodiment, in the open position.
Figure 22:
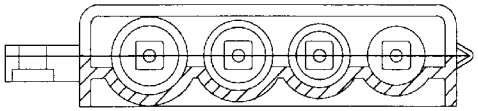
FIG. 22 is a corresponding partial bottom cross-sectional view.

In another embodiment of the invention, as shown in FIGS. 20–22, the tool case is adapted to receive long sockets.

Figure 23:
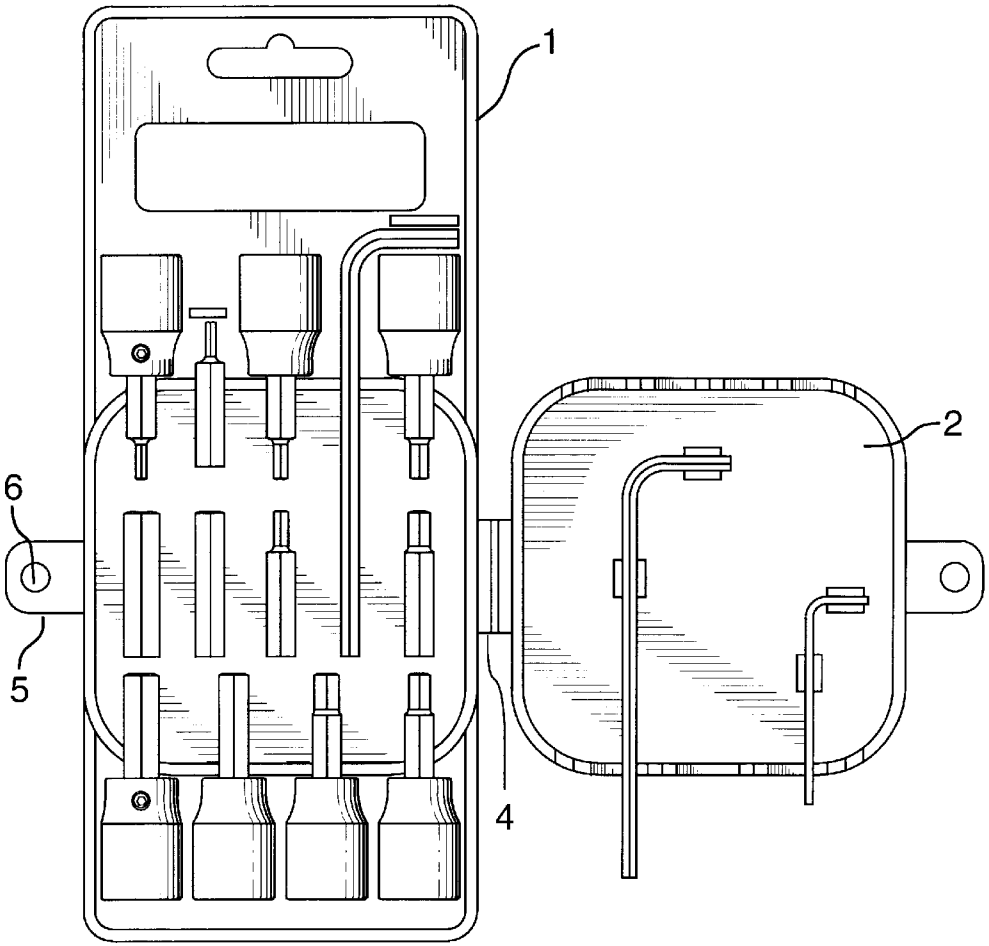
FIG. 23 is a plan view of a sixth embodiment, in the open position.
Figure 24:
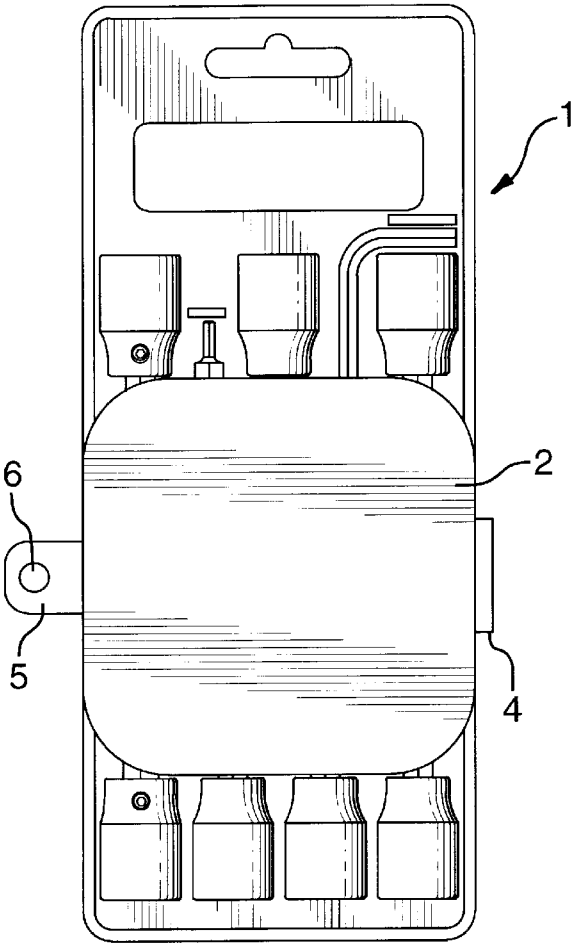
FIG. 24 is a corresponding view in the closed position.

In another embodiment of the invention, as shown in FIGS. 23–24, the tool components consist of a variety of different tool types and size combinations. This is to illustrate the many varied embodiments are available with this invention.

It should be appreciated that many variations on the above will be evident to those who are knowledgeable in the field, and obvious variations are intended to be within the scope of the invention as defined by the following claims.

What is claimed as the invention is:

1. A tool case for tool components, comprising:

a card member, and a lid specifically configured to mate with said card member to define an enclosed area, said lid being hinged to said card member adjacent one edge thereof so as to be foldable between an open position away from said card member, and a closed position against said card member to define said enclosed area;

said card member and lid further defining between them a plurality of openings through said enclosed area particularly sized for stored tool components to extend partially therethrough;

tool component receiving means on said card member;

at least one of said enclosed area and an area of said card member outside said enclosed area having at least one stop surface separate from surfaces defining said openings, each said stop surface positioned so as to block removal of a tool component through said openings from said enclosed area when said lid is in said closed position.

2. A tool case as recited in claim 1, where said tool component receiving means comprises a plurality of recesses depending from said card member, generally sized to accommodate tool components, with portions of said tool components extending through said openings into said enclosed area, removal of said tool components when said lid is in the closed position being prevented by said stop at least one stop surface and by said lid bearing against said portions to hold said tool components within said recesses.

3. A tool case as recited in claim 2, where said lid further comprises a plurality of clip projections therefrom, each to snugly accommodate additional tool components, with portions of said additional tool components extending from said enclosed area through further openings provided through said lid.

4. A tool case as recited in claim 2, where said tool component receiving means comprises a plurality of recesses in said card member outside said enclosed area, generally sized to accommodate socket portions of sockets with portions of said sockets extending through said openings into said enclosed area, removal of said sockets when said lid is in the closed position being prevented by said at least one stop surface and by said lid bearing against said socket portions to hold said socket portions within said recesses.

5. A tool case as recited in claim 2, where said tool component receiving means comprises a plurality of recesses in said card member outside said enclosed area, generally sized to accommodate socket portions of bit-sockets, with bit portions of said bit-sockets extending through said openings into said enclosed area, removal of said sockets when said lid is in the closed position being prevented by said at least one stop surface and by said lid bearing against said bit portions to hold said socket portions within said recesses.

6. A tool case as recited in claim 5, wherein at least one of said at least one stop surface comprises an end wall of one said recess.

7. A tool case as recited in claim 6, wherein said recess is arcuate-shaped.

8. A tool case as recited in claim 5, where said tool component receiving means further comprises opposing projections from said card member within said enclosed area, configured to snugly accommodate bit portions of said bit-sockets between them.

9. A tool case as recited in claim 8, where there are three said recesses in said card member outside one end of said enclosed area and two said recesses outside an opposite end of said enclosed area, whereby five bit-sockets may be accommodated with bit portions extending into said enclosed area, said enclosed area having five pairs of said opposing projections, each to accommodate a bit portion of one of said five bit-sockets.

10. A tool case as recited in claim 9, where said lid further comprises a plurality of clip projections therefrom, each to snugly accommodate additional tool components, with portions of said additional tool components extending from said enclosed area through further openings provided through said lid, towards said end of said card member having said two arcuate recesses, laterally outwardly from said card member.

11. A tool case as recited in claim 1, where said tool component receiving means comprises a plurality of arcuate recesses in said card member within said enclosed area, generally sized to accommodate socket portions of bit-sockets, with bit portions of said bit-sockets extending through said openings out of said enclosed area, removal of said sockets when said lid is in the closed position being prevented by said at least one stop surface and by said lid bearing against said socket portions.

12. A tool case as recited in claim 11, where said arcuate recesses and said openings are aligned such that said bit portions of installed bit-sockets extend laterally from opposite side edges of said enclosed area.

13. A tool case as recited in claim 1, where said tool component receiving means comprises a plurality of recesses in said card member, generally sized to accommodate sockets, some said recesses each having a tab extending from an edge thereof so as to extend into a cavity of a said socket when positioned therein, with portions of some said sockets extending through said openings out of said enclosed area, removal of said sockets when said lid is in the closed position being prevented by said at least one stop surface and by said lid bearing against said some sockets.

14. A tool case as recited in claim 1, where said card member includes a portion extending substantially beyond any area of said card member configured for tool components to be positioned, said portion having an opening therethrough to permit hanging said card member on a peg.

15. A tool case as recited in claim 1, where said card member and lid each having tabs extending from side edges opposite the hinged edge, each said tab having a hole generally alignable with a corresponding hole in the other tab.

16. A tool case as recited in claim 1, wherein at least one of said at least one stop surface comprises a projection from said card member.

17. A tool case as recited in claim 1, wherein said lid includes at least one window thereon.

* * * * *